US007655903B2

(12) United States Patent
Zubarev et al.

(10) Patent No.: US 7,655,903 B2
(45) Date of Patent: Feb. 2, 2010

(54) MEASURING CELL FOR ION CYCLOTRON RESONANCE MASS SPECTROMETER

(75) Inventors: Roman Zubarev, Uppsala (SE); Alexander Misharin, Uppsala (SE)

(73) Assignee: Bruker Daltonik GmbH, Bremen (DE)

( * ) Notice: Subject to any disclaimer, the term of this patent is extended or adjusted under 35 U.S.C. 154(b) by 247 days.

(21) Appl. No.: 11/737,300

(22) Filed: Apr. 19, 2007

(65) Prior Publication Data

US 2007/0278402 A1 Dec. 6, 2007

(30) Foreign Application Priority Data

Apr. 27, 2006 (SE) ..... 0600934

(51) Int. Cl.
*H01J 49/36* (2006.01)

(52) U.S. Cl. ..... 250/291; 250/292; 250/281; 250/397

(58) Field of Classification Search ..... 250/288, 250/282, 291, 307, 281, 293, 397
See application file for complete search history.

(56) References Cited

U.S. PATENT DOCUMENTS

| | | | | |
|---|---|---|---|---|
| 4,990,775 A | | 2/1991 | Rockwood et al. | |
| 5,019,706 A | | 5/1991 | Allemann et al. | |
| 5,455,418 A | | 10/1995 | Hogan | |
| 5,561,291 A | * | 10/1996 | Kelley et al. | 250/282 |
| 6,114,692 A | * | 9/2000 | Beu | 250/282 |
| 6,121,609 A | * | 9/2000 | Littlejohn | 250/288 |
| 6,232,599 B1 | * | 5/2001 | Littlejohn | 250/288 |
| 6,355,929 B1 | * | 3/2002 | Littlejohn et al. | 250/288 |
| 2005/0178961 A1 | * | 8/2005 | Beu et al. | 250/291 |
| 2006/0027743 A1 | * | 2/2006 | Franzen et al. | 250/286 |
| 2006/0226357 A1 | * | 10/2006 | Franzen et al. | 250/307 |

FOREIGN PATENT DOCUMENTS

| | | |
|---|---|---|
| GB | 2 420 006 A | 5/2006 |
| RU | 1819049 A1 | 7/1994 |
| SU | 1307492 A1 | 4/1987 |

OTHER PUBLICATIONS

Amster I. Jonathan, "Fourier Transform Mass Spectrometry", Journal of Mass Spectrometry, vol. 31, 1325-1337 (1996), John Wiley & sons, Ltd.

Guan, et al., "Ion Traps for Fourier Transform Ion Cyclotron Resonance Mass Spectrometry: Principles and Design of Geometric and Electric Configurations", International Journal of Mass Spectrometry and Ion Processes, 146/147 (1995) 261-296, Elsevier Science B.V.

* cited by examiner

*Primary Examiner*—Nikita Wells
*Assistant Examiner*—Johnnie L Smith
(74) *Attorney, Agent, or Firm*—Law Offices of Paul E. Kudirka

(57) ABSTRACT

An ion cyclotron resonance cell has at least one trapping electrode comprised of electrically isolated sections that are used for the detection of an induced ion image signal. Such an arrangement increases the sensitivity of image signal detection without a significant increase in the amplitude of parasitic harmonics. When a multielectrode detection arrangement is used, the resolving power of an analyzer incorporating such a cyclotron resonance cell multiplies without a corresponding sensitivity loss.

7 Claims, 2 Drawing Sheets

MEASURING CELL FOR ION CYCLOTRON RESONANCE MASS SPECTROMETER

BACKGROUND

This invention relates to a measuring cell for an Ion Cyclotron Resonance (ICR) mass spectrometer.

Fourier Transform Ion Cyclotron Resonance (FT-ICR) is a technique for high resolution mass spectrometry.

Ion motion in a homogeneous magnetic field in a plane perpendicular to the direction of the field represents a circular orbit. This circular orbiting of an ion is termed "cyclotron motion" or "cyclotron oscillation". The frequency of the cyclotron oscillation is inversely proportional to the mass-to-charge ratio m/z of the ion and directly proportional to the strength of the magnetic field. This motion is usually measured by a detection of the image current induced by an ensemble of oscillating ions on an electrode (called "detection electrode") followed by a subsequent Fourier transformation of the signal. This gives a spectrum of the frequencies of the cyclotron oscillations of simultaneously trapped ion ensembles and hence ionic mass-to-charge ratios m/z, which serves as a basis for the FT-ICR mass spectrometry method.

In order to constrain ion motion in the direction along the homogeneous magnetic field and to detect ion motion, FT-ICR mass spectrometers confine ions in cells (sometimes called traps) of various configurations. Descriptions of a number of FT-ICR cells can be found for example in the publication of Shenheng Guan, and Alan G. Marshall; International Journal of Mass Spectrometry and Ion Processes 146/147 (1995) 261-296. The ion motion of the ions trapped inside the cell is restrained in the plane perpendicular to the magnetic field by the magnetic field itself, and in the dimension along the magnetic field by an electrostatic trapping potential. The ion motion inside the cell can generally be represented as a superposition of three periodic motions:

(1) an oscillation along the axis z parallel to the magnetic field called trapping oscillation,
(2) a cyclotron rotation in the plane perpendicular to the magnetic field, and
(3) a magnetron drift motion in that plane generated by radial electrostatic forces.

The frequencies of these motions are usually denoted as $\omega_z$, $\omega_c$ and $\omega_m$ respectively.

For generating mass spectra, a "reduced ion cyclotron frequency $\omega_+$" is measured which is composed of the above frequencies of motions. The true cyclotron frequency $\omega_c$ cannot be measured directly. The reduced cyclotron frequency can be calculated theoretically from the cyclotron frequency $\omega_c$ and the trapping frequency $\omega_z$. As long as the electrostatic trapping potential is quadrupolar, the reduced cyclotron frequency $\omega_+$ does not depend on the axial and radial positions of the ion inside the cell, and a high mass resolution is achieved. The quadrupolar potential is produced by cell electrodes formed as hyperbolic surfaces. A trapping potential more or less approximating the ideal quadrupolar one exists in the vicinity of the center of a cell of any geometry, particularly in cylindrical cells. The size of the region with sufficiently good quadrupolar trapping potential depends on the form of the cell.

The electrodes to which the trapping potential is applied are called trapping electrodes. The trapping electrodes usually arranged essentially perpendicular to the direction of the magnetic field.

The frequency $\omega_+$ of ion motion is usually detected via an image charge induced on cell electrodes called detecting electrodes. The detecting electrodes usually are lengthy electrodes essentially parallel to the magnetic field lines. In conventional FT-ICR cells, the detection signal increases when the diameter of the cyclotron motion becomes larger, and when ions of the same mass-to-charge ratios are moving in the same phase. This is valid up to the point where the ion orbit becomes comparable with the internal dimension of the cell, i.e. when the ions fly near to the detection electrodes. To obtain such a coherent motion with an enhanced cyclotron radius, the cyclotron oscillations of trapped ions are usually excited by subjecting them to an oscillating electric field applied perpendicular to the direction of the magnetic field and having a frequency equal to the cyclotron frequency of the ions. This excitation electric field is applied to so-called excitation electrodes of the cell. Sometimes the same electrodes are used for both excitation and detection, but it is more common to have separate excitation and detection electrodes.

The excitation/detection and trapping electrodes must not be plane electrodes. They may have the surface of a cube, or cylinder, or hyperboloid of revolution. According to the shape of the surface the cell is then referred to as cubical or cylindrical of hyperbolic cell, respectively.

The main disadvantage of the currently used FT-ICR cell designs is the long acquisition time required to achieve good resolving power. Because of the principle limitations associated with the Fourier transform, the signal acquisition duration T to obtain resolution R is given by $$T=4\pi R/\omega_c \quad (1)$$

[Jonathan Amster; Journal of Mass Spectrometry, vol. 31, 1325-1337 (1996)].

Thus short analyses times result in low resolution. To overcome this limitation, it was suggested to use multielectrode detection plate arrangements [E. N. Nikolaev et al. SU patent 1307492 A1 (1985). Alan Rockwood et al., U.S. Pat. No. 4,990,775 (1991)]. In these arrangements, each of the detection electrodes is split into several smaller electrodes, and they are connected to an amplifier of the image signal in such a way that the detection occurs on a multiple of the reduced cyclotron frequency $\omega_+$, e.g on $n \cdot w_+$, where n is integer.

The main drawback of the multiple electrode detection cells is their low sensitivity. This drawback results from the fact that an ion residing inside an FT-ICR cell induces an image signal on all cell electrodes simultaneously. Since only some of the electrodes are used for detection, the detection efficiency is reduced compared to a cell entirely consisting of detecting electrodes. Furthermore, for efficient detection some of the detecting electrodes should be connected to a positive pole of an image signal amplifier, while other detection electrodes should be connected to the negative pole of the same amplifier, and during the detection an ion must come close to detecting electrodes of different polarity in alternating order. It is essential, that an ion induces at a given time an image signal preferentially in one of the detector plates only. This is achieved for diameters of the cyclotron orbits close to the cell dimension in the plane of the cyclotron motion. To obtain the same sensitivity with a multielectrode cell, the cyclotron diameter has to be larger for larger n.

However, diameters exceeding approximately half of the cell dimension lead to an increase in the amplitudes of parasitic harmonics, i.e. undesired signals occurring on the frequency $m \cdot w_+$. The desire to limit the amplitude of higher harmonics, in practice to below approximately 10% of the total signal for each harmonic frequency, requires a limitation of the excitation of the ion's cyclotron orbits to diameters smaller than half of the cell dimension, which leads to a low sensitivity of the detection, especially for multielectrode cells. Another reason for keeping diameters of the ion cyclotron motion relatively small is that for all cells (except for the ideal hyperbolic cells) the trapping potential deviates from the quadrupolar one for relatively large distances from the center of the cell. This deviation leads to the change in $\omega_+$ for ions excited to different cyclotron orbits and thus in the degradation of resolution and mass accuracy.

Therefore, there is a need to keep radii of the ion cyclotron motion small compared to the inner radius of the cell in a plane perpendicular to the direction of the magnetic field. But this requirement leads to the decrease in sensitivity of the measurements in all prior art cells.

SUMMARY

It is the object of the present invention to provide an improved ICR cell that for a fixed sensitivity and a fixed acquisition time achieves an increase of the resolving power, alternatively providing shorter acquisition times for a fixed resolving power.

The foregoing and other objects of the present invention are achieved by an ICR cell by using the trapping electrodes for the detection of the image currents. For this purpose, the trapping electrodes have to be divided into sections. In this description, the trapping electrodes now used for detection are still denominated as "trapping electrodes", even if the trapping potential may now be fed to other electrodes, for instance, to the electrodes hitherto used for detection.

At least one of the trapping electrodes must be segmented into electrically isolated electrode sections. The sections which may have any form, are connected to the image signal amplifier. Favorably, each of the two trapping electrodes are segmented into sections of the same form. Most favorably, the two trapping electrodes are comprised of one or more pairs of sectors of surfaces of revolution and said sectors are used for bipolar detection of the induced image signal. Opposite sectors on different trapping electrodes are aligned against each other and connected to the same input of the image signal amplifier. The trapping electrodes are essentially symmetric with respect to the turn around the main axis by an angle of 360°/n, where n is the number of pairs of sectors in each trapping electrode. Neighboring sectors are connected to opposite inputs of the image signal amplifier.

In such a cell, detection of the reduced cyclotron motion is performed by electrodes placed essentially parallel to the plane of the cyclotron orbit and perpendicular to the direction of the magnetic field. Detection is performed in the bipolar fashion when each of the detection electrodes is connected either to the positive or to the negative input of the image signal amplifier. Due to the location of the detection electrodes of the cell there is no need to excite ions to large cyclotron orbits in order to achieve high signal intensity. Actually, maximum signal intensity in the cell disclosed in the present patent application is achieved for cyclotron radii in the vicinity of the half the cell radius. This result is obtained in computer simulations of the dependences of the signal vs. radius in such a cell.

DETAILED DESCRIPTION

While the invention has been shown and described with reference to a number of embodiments thereof, it will be recognized by those skilled in the art that various changes in form and detail may be made herein without departing from the spirit and scope of the invention as defined by the appended claims.

Figure 1:
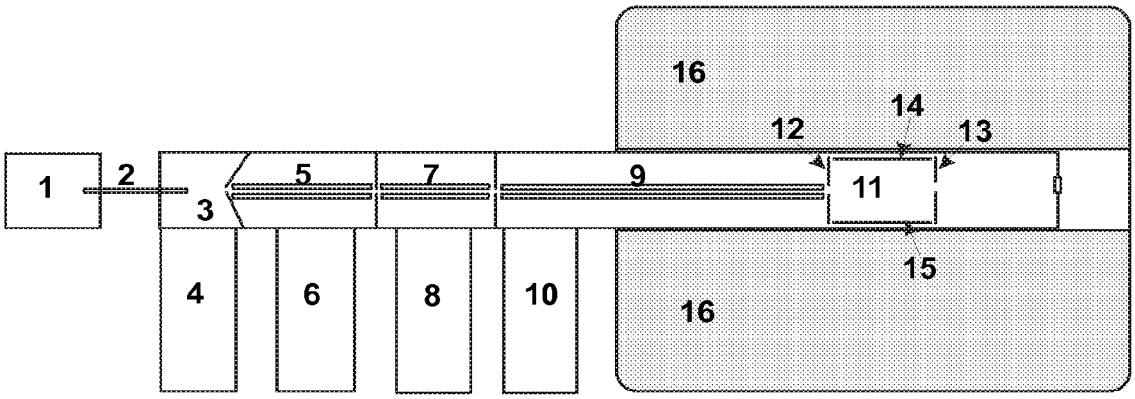
FIG. 1 (Prior Art)
FIG. 1 illustrates the principle of a FT-ICR mass spectrometer according to the state of the art, showing an ion source (1), an ion input capillary (2), a differential pumping system with pumps (4, 6, 8, 10), and with an ion guide (5, 7, 9), leading the ions into the ICR cell (11) located in the magnetic field of a superconducting magnet (16). The ICR cell shows two trapping electrodes (12, 13) and some side electrodes (14, 15) for excitation or detection. In this example, the ICR cell is cylindrical.
Figure 2:
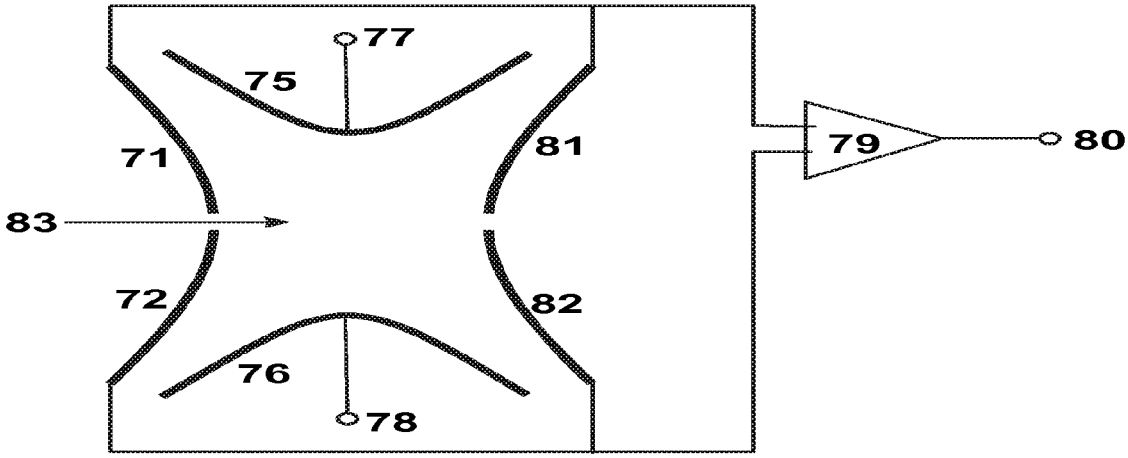
FIG. 2 schematically presents an ICR cell of hyperbolic form. Here the sectors (71, 72, 81, 82) serve for the detection of the image currents (according to this invention) and are connected to the input lines of the image signal amplifier (79). The electrodes (75, 76) are used for excitation, and they are connected to the trapping potentials via connectors (77, 78). The line (83) denotes the direction of the magnetic field and the input path for ions.
Figure 3:
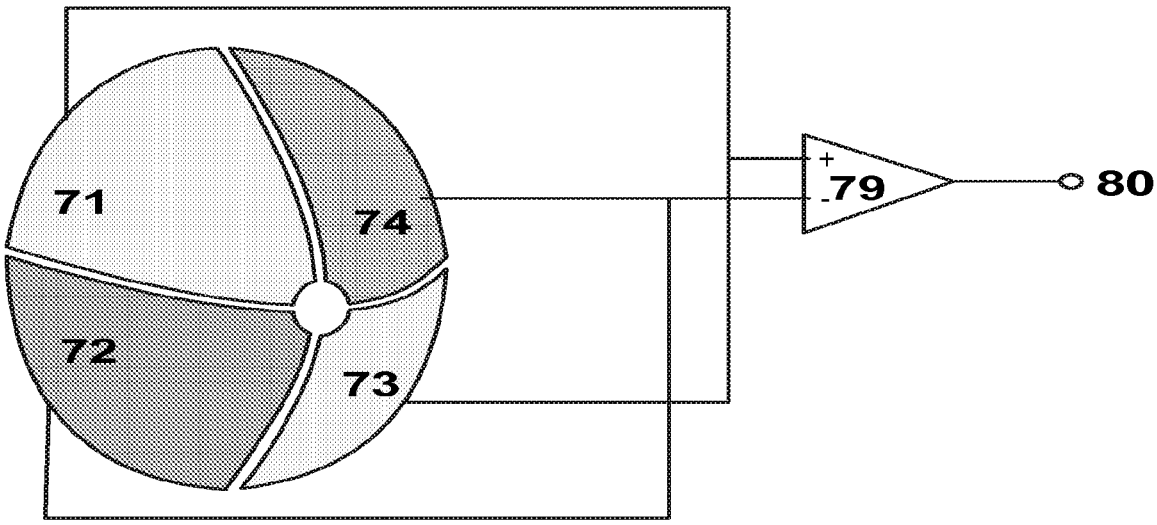
In FIG. 3, one of the trapping electrodes from FIG. 2 is presented in three dimensions, showing the four sectors (71-74) and their connections to the inputs of the image signal amplifier (79).

The cell disclosed in the present patent application can for example have the arrangement of electrodes as in FIGS. 2 and 3. The following description should not limit the scope of the present invention to a particular embodiment and serves the purposes of illustration and explanation only.

The cell is placed in a uniform magnetic field B with direction (83) and is enclosed within an evacuated chamber (not shown). FIG. 2 shows a cross-section of the cell in a plane parallel to the axis of rotational symmetry of the cell. The ring electrode (75, 76) of the cell, divided into segments (not visible), is used for excitation of the ion cyclotron motion. A DC potential is applied to all segments of this electrode to create a trapping potential well inside the cell. To reduce the magnetron motion of the ions, quadrupolar or higher order excitation methods should preferentially be used to excite the ion's cyclotron motion. Detection of the ion cyclotron motion is performed on a multiple of the cyclotron frequency using the "trapping" electrodes of the cell placed essentially perpendicular to the direction of the magnetic field. One of the "trapping" electrodes is shown in the FIG. 3. The electrode is composed of four sectors of a hyperbolic surface of revolution which axis of rotational symmetry is parallel to the direction of the magnetic field. Each of the sectors is connected to a certain input of the image signal amplifier. As FIG. 3 shows, sectors 71 and 73 are connected to the positive input while sectors 72 and 74 are connected to the negative input of the amplifier. Sectors of the other "trapping" electrode of the cell are oriented "face-to-face" with the sectors of the first "trapping" electrode and connected to the same input of the image signal amplifier as the corresponding sector of the first "trapping" electrode, as shown in FIG. 2. The electrical connections of the sectors of the "trapping" electrodes shown in the FIGS. 2 and 3 allow a detection of the second harmonic of the cyclotron frequency which theoretically requires twice shorter time to achieve a certain mass resolution than that required in a conventional "dipole" mode of detection. According to computer simulations of the dependence of the signal amplitude vs. radius of the cyclotron motion, sensitivity of such a cell as shown in the FIGS. 2 and 3 for radii less than half of the cell radius is close to the sensitivity of the cell of the same dimensions employing a conventional "dipole" mode of detection measuring the image currents on the ring electrode, and it is significantly higher than that for a cell of the same dimensions employing detection on the second harmonics using ring electrode of the cell. Therefore, the purpose of increasing the resolving power without drop of sensitivity is achieved in such a cell according to the invention.

What is claimed is:

1. An ion cyclotron resonance cell located in a magnetic field having magnetic field lines within which ions travel with cyclotron motion, the cell comprising:

a plurality of trapping electrodes oriented substantially perpendicular to the magnetic field lines, wherein at least one of the plurality of trapping electrodes has a plurality of electrically isolated sections, and a detector connected to the sections for bipolar detection of induced ion image signals produced by the cyclotron motion.

2. The ion cyclotron resonance cell of claim 1, wherein the ion cyclotron cell has a central axis and wherein the sections are formed as pairs of sectors arranged symmetrically around the central axis.

3. The ion cyclotron resonance cell of claim 2, wherein the detector comprises an image signal amplifier having a plurality of inputs and wherein the trapping electrodes are arranged in opposition along the central axis, each of the plurality of trapping electrodes has pairs of sectors, and wherein opposing sectors of different trapping electrodes are connected to the same input of the image signal amplifier.

4. The ion cyclotron resonance cell of claim 3 wherein the trapping electrodes are substantially axially symmetric and each trapping electrode has n pairs of sectors, where $n \geqq 1$.

5. The ion cyclotron resonance cell of claim 2 wherein adjacent sectors of each trapping electrode are connected to the detector to detect ion image currents of opposite polarity.

6. The ion cyclotron resonance cell of claim 2 wherein the cyclotron motion occurs at a reduced cyclotron frequency and wherein n neighboring pairs of sectors are connected to the detector in order to generate a detected frequency of n times the reduced cyclotron frequency.

7. The ion cyclotron resonance cell of claim 1 wherein each trapping electrode has a surface formed as one of a plane, a hyperbole of revolution, a section of a sphere, and a cone.

* * * * *